FIG. 1
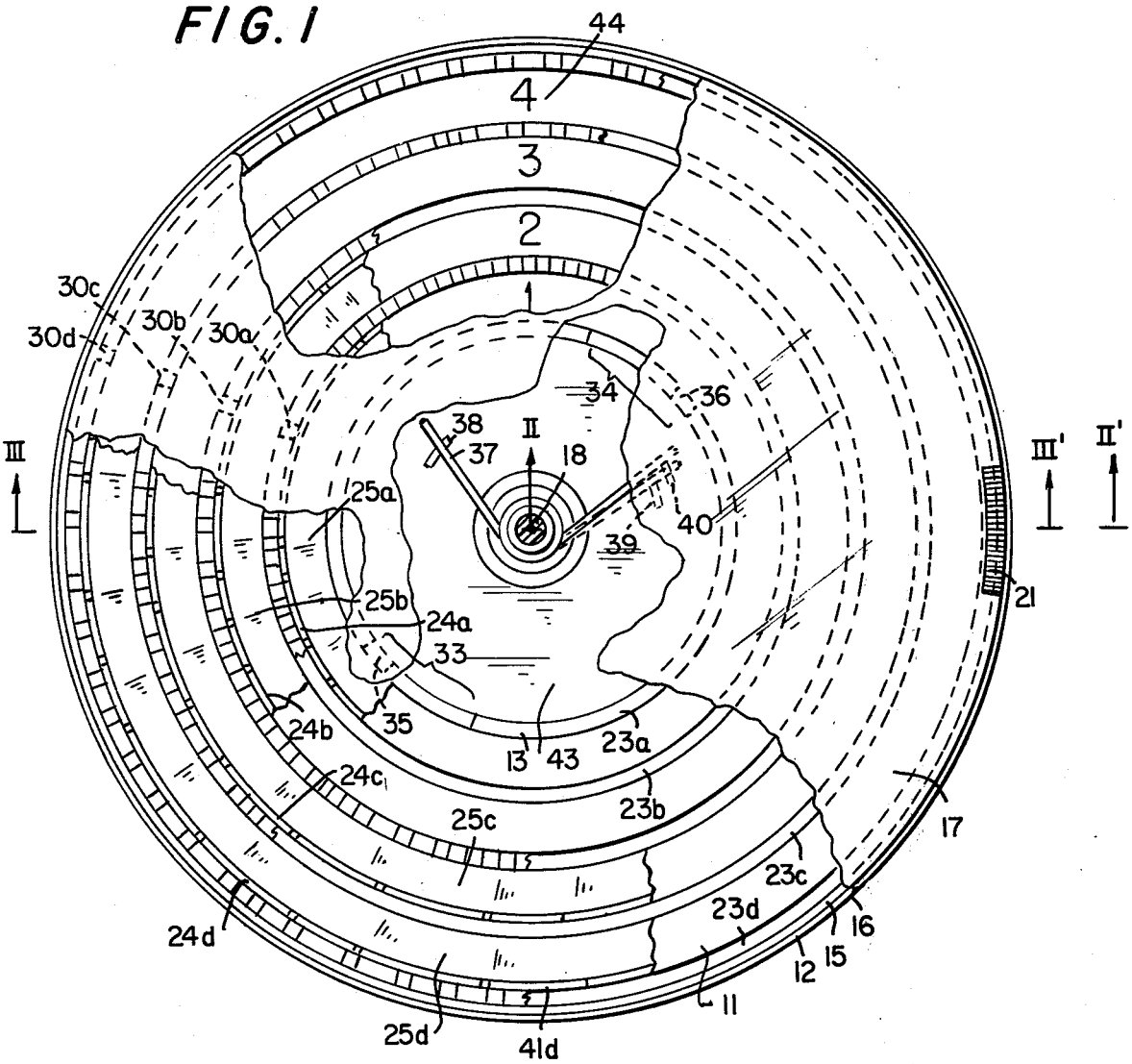
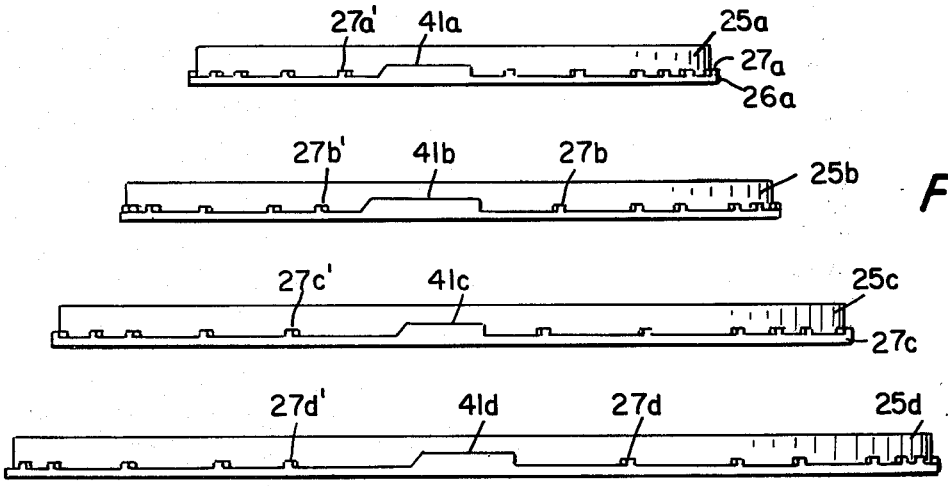
FIG. 6

United States Patent [19]

Bertin

[11] 4,163,556

[45] Aug. 7, 1979

[54] VARIED TRACK ADVANCEMENT GAME MECHANISM

[76] Inventor: George Bertin, 35 W. 93rd St., New York, N.Y. 10025

[21] Appl. No.: 896,749

[22] Filed: Apr. 17, 1978

[51] Int. Cl.[2] ..... A63F 5/04; A63F 9/14

[52] U.S. Cl. ..... 273/86 H; 273/142 HA

[58] Field of Search ..... 273/86 H, 142 H, 142 HA

[56] References Cited

U.S. PATENT DOCUMENTS

| | | | |
|---|---|---|---|
| 390,763 | 8/1888 | Kauffmann | 273/142 HA |
| 870,473 | 11/1907 | Schultze | 273/86 H |
| 2,643,885 | 6/1953 | Ford | 273/86 H UX |

*Primary Examiner*—Anton O. Oechsle

*Attorney, Agent, or Firm*—Jacobs & Jacobs

[57] ABSTRACT

A game mechanism is described in which a plurality of tracks are advanced by pawl mechanisms. Associated with each track is a program ring which modifies the rotational advancement of the track which would otherwise be obtained through advancement of the pawl.

8 Claims, 6 Drawing Figures

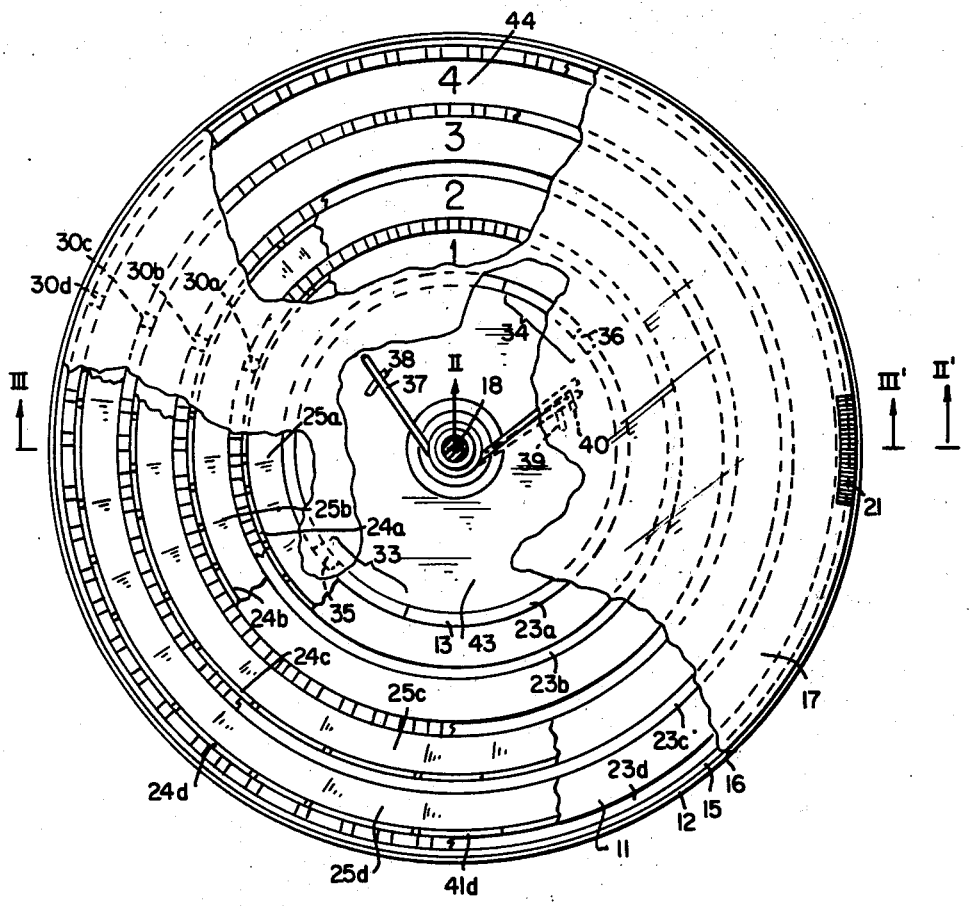

VARIED TRACK ADVANCEMENT GAME MECHANISM

DETAILED DESCRIPTION

Various games and toys are known in which discs or bands carrying indicia are advanced through ratchets and pawls. Diversity of movement between a plurality of such discs or tracks has been achieved in a number of fashions, including varying the friction on the bearings as in U.S. Pat. No. 820,819; utilizing a plurality of activating levers each of which advances one track as in U.S. Pat. No. 1,822,873 and incorporating pneumatic timing devices which momentarily interrupts the locking action of the pawl and permits free spinning of the discs, as in U.S. Pat. No. 3,810,628.

The present invention pertains to a game or toy in which circular tracks which can display indicia are advanced at varying rates in response to a series of strokes by the player or players. The series of steps by which the tracks advance can be made systematic and predictable, so as to be suitable for a game of strategy, or so complex as to be practically unpredictable. The principal feature of the invention involves the association with each of a plurality of pawl-driven circular tracks of a program ring which modifies the action of the pawl on the track associated with that pawl.

The object of the invention and manner in which one makes and uses the invention are described in the following specification and drawings, in which FIG. 1 is a top view of the device with portions broken away to reveal its various internal components;

FIG. 6 is an exploded side elevation from the six o'clock position in FIG. 1 of the four tracks shown in FIG. 1.

Figures 2, 3, 4, 5:
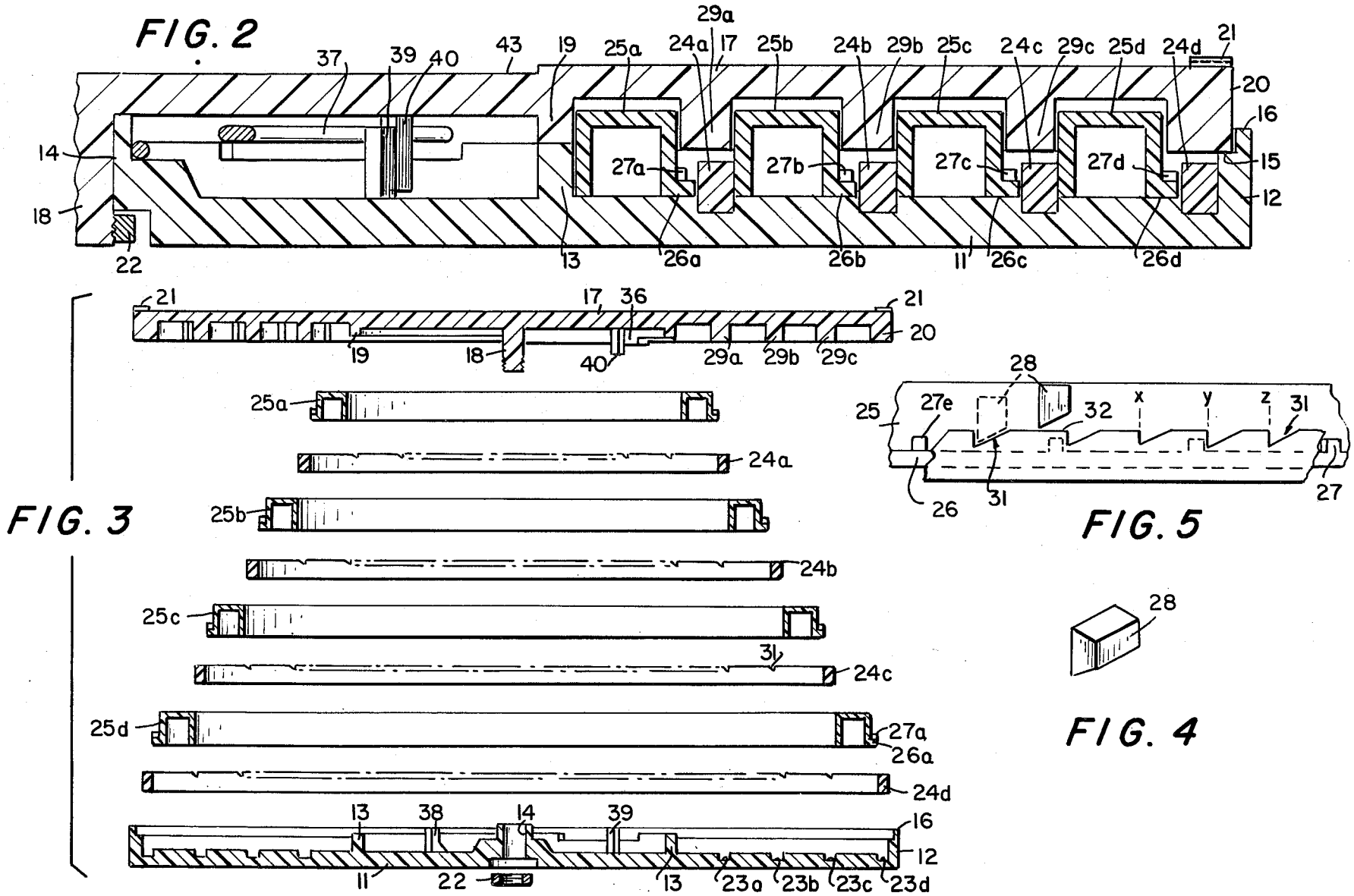
FIG. 2 is a cross-section of the device, greatly enlarged, taken generally along the radius II—II' of FIG. 1.
FIG. 3 is an exploded cross-section taken along lines III—III' of FIG. 1.
FIG. 4 is a perspective view of a typical pawl.
FIG. 5 is a schematic view of a developed portion of the track and program ring, showing the relative position of an accociated pawl.

Referring now to the drawings in greater detail, a base 11 has a circular outer wall or border 12 and an inner wall or ridge 13 concentrically disposed about bearing element 14. Outer wall 12 is developed to provide shoulder portion 15 and lip 16.

Circular cover 17, which is transparent, is concentrically developed about shaft 18 which is journaled in bearing 14. Inner skirt 19 rides on inner wall 13 and outer skirt 20 rides in part upon shoulder 15, the diameter of cover 17 being such that it fits within lip 16 of outer wall 12 for free rotation. Cover 17 can be provided with ribbed gripping surface 21 to effect rotation or cover 17 can be rotated relative to base 11 by simply grasping the two components. Shaft 18 once inserted in bearing 14 can be secured by attachment of a fastener 22.

Defined in base 11 are a plurality of channels **23*a*, 23*b*, 23*c* and 23*d* in which ride a like plurality of program rings 24*a*, 24*b*, 24*c* and 24*d*, respectively. Together with inner wall 13, these rings define a plurality of concentric courses in which ride tracks 25*a*, 25*b*, 25*c* and 25*d*. Each of tracks 25*a*, 25*b*, 25*c* and 25*d* has a rim portion 26*a*, 26*b*, 26*c* and 26*d*, respectively, on which are developed a plurality of catches or teeth 27, designated generally as 27*a* for track 25*a*, 27*b* for track 25*b*, 27*c* for track 25*c* and 27*d* for track 25*d***, which define spaced interdental recesses operable to receive a pawl for subsequent engagement of the next catch or tooth.

There is defined on the bottom of cover 17 between inner skirt 19 and outer skirt 20, a series of partitions **29*a*, 29*b* and 29*c*, each of a width just slightly less than the combined radial dimensions of the corresponding program ring and track rim. Outer skirt 20 is extended inwardly a like amount so that starting from inner skirt 19, partitions 29*a*, 29*b* and 29*c* and outer skirt 20, define a plurality of upper concentric channels through which tracks 25*a*, 25*b*, 25*c* and 25*d*** pass.

At one radial position, the concentric partitions **29*a*, 29*b* and 29*c* and the inward extension of outer skirt 20 are interrupted to define a pawl-receiving cavity 30*a*, 30*b* and 30*c*, with a further cavity 30*d* being defined in the inward extension of outer skirt 20. These recesses are rectangular and of such dimensions as to admit a pawl, shown generally in FIG. 4, for free vertical movement within the recess, the pawl being restrained from radial movement by adjacent tracks, and in the case of track 25*d* by outer skirt 20**.

Each of program rings **24*a*, 24*b*, 24*c* and 24*d* is notched, as shown generally by 31. The notches are located at various angular intervals, which intervals will be precisely chosen but varied in sequence. By way of example, the radian of x-y in FIG. 5 can be for example 6° whereas the radian y-z can be 4°. Selection of the sequence of these intervals will depend upon design objects, as is discussed below. The sequence of notches on each program ring may differ. Alternatively, the sequence can be paired so that, for example, rings 24*a* and 24*c* can have the same sequence and rings 24*b* and 24*d* can have the same sequence, but one different from that of rings 24*a* and 24*c***. Finally, the sequence can be identical for each of the program rings, provisions then being provided as described hereafter to nevertheless alter the advancement of the rings.

Program rings **24*a*, 24*b*, 24*c* and 24*d* are of such vertical dimension that when positioned in channels 23*a*, 23*b*, 23*c* and 23*d*, the upper pawl restraining surface 32 is above the upper surface of teeth 27. Notches 31, on the other hand, are deep enough to allow pawl 28 to reach and engage teeth 27. Notches 31 are angled so as to correspond to the angle of the pawl 28**, allowing the pawl to be pushed out of the notch when driven in one direction but causing the pawl to engage and move the program ring when driven in the opposite direction.

As can be seen in FIG. 5, pawl 28 (shown in solid lines) thus rides along pawl-restraining surface 32, which prevents the pawl from falling into interdental track recesses between teeth 27. When pawl 28 encounters notch 31, it descends therein under the forces of gravity and is then operable to engage the next tooth **27*e* on rim 26 of track 25. Further advancement of pawl 28 will then advance both program ring 24 and track 25**.

Within inner wall 13 of base 11 is provided a pair of diametrically disposed recesses 33 and 34 of an equal angular dimension. Cover 17 is provided with corresponding stops 35 and 36 which are of an equal angular length which is less than the dimension of recesses 33 and 34. Acting in association with recesses 33 and 34, stops 35 and 36 define the maximum rotational displacement of top 17 relative to base 11.

Spring 37 is mounted about shaft 14. One arm of spring 37 engages retaining peg 38 which projects up from base 11. The second arm of spring 37, prior to assembly, is temporarily held by retaining peg 39, also projecting up from base 11. During assembly, retaining peg 40 projecting down from cover 17 assumes this role and retaining peg 39 thereafter becomes passive. Upon assembly and the engagement of spring 37 by retaining pegs 38 and 40, a torque is exerted on cover 17 relative to base 11, which torque is restrained by the engagement of stops 35 and 36 against the end walls of recesses 33 and 34. Cover 17 can thus be rotated manually until stops 35 and 36 contact end walls of recesses 33 and 34. Upon release, cover 17 is urged by spring 37 in the reverse direction until stops 35 and 36 come in contact with the opposite end walls of recesses 33 and 34.

Disposed on rim 26 of each track 25 is a raised indexing element, shown as **41*c* on track 25*c* and 41*d* on track 25*d* in FIG. 1 and as 41*a*–41*d* for tracks 25*a*–25*b*, respectively, in FIG. 6. The indexing element is disposed so that the distance from pawl engaging face 42*a*–42*d* to the next tooth or catch, 27*a*'–27*d*', respectively, is just less than the maximum distance which stops 35 and 36 permit top 17 to rotate within recesses 33 and 34. Consequently, a "full stroke" is required to advance the tracks in this area. By use of a series of smaller strokes, all tracks can be brought into alignment for commencement of the game. Indexing elements 41*a*, 41*b*, 41*c* and 41*d* are higher than teeth 27*a*, 27*b*, 27*c* and 27*d* (all teeth on a track being of the same height) and also higher than the associated program rings 24*a*, 24*b*, 24*c* and 24*d***. Consequently, all tracks will move away from the starting line in unison on the first "full stroke", whatever the position of the programming rings at that time.

The various elements of the game are assembled by placing the four program rings **24*a*, 24*b*, 24*c* and 24*d* into channels 23*a*, 23*b*, 23*c* and 23*d*, respectively, of base 11, inserting tracks 25*a*, 25*b*, 25*c* and 25*d* in the recesses between the program rings, and setting spring 37 between retaining pegs 38 and 39. An appropriate number of like pawls 28 are positioned in an interdental recess of each track and a notch of its associated program ring and shaft 18 of cover 17 is inserted into bearing 14. Cover 17 is twisted slightly so that retaining peg 40 engages spring 37 and cover 17 is then lowered until pawls 28 are admitted in recesses 30*a*, 30*b*, 30*c* and 30*d* with stops 35 and 36 moving into recesses 33 and 34. Fastener 22 is then secured to shaft 18, allowing just sufficient play that cover 17 rotates freely. A decal or similar covering can be positioned over the center portion 43 in order to hide the spring mechanism. Indicia 44** can be associated with each track to reflect its advancement relative to the others.

Upon rotation of cover relative to base, each pawl will be advanced over the pawl-restraining surface of its associated program ring and track. Since this upper surface of the program ring is slightly higher than the catches or teeth on the track, neither track nor ring is engaged. The pawl however will drop into the first available notch on the program ring and move the ring along, the rings being free to rotate. When in a notch, the pawl is in position to engage the first tooth of its associated track and move the track. In the course of a series of strokes of the top cover, the rings move faster than the tracks, and their position relative to the tracks will change as well as their position relative to the cover and base. The result of each stroke is now difficult to predict (unless systematically programmed to be predictable), particularly if the teeth portions of the tracks and the rings are hidden from the player's view, as by a series of concentric decals. The tracks can move by angles either equal to or smaller than the cover stroke or for some strokes may not move at all. The combination of tooth spacing on the tracks and notch spacing on the rings constitutes the program of the game or toy and may be made as systematic as desired.

The dimensions of the device, the positioning of the notches in the program rings and the number of degrees for individual strokes can vary widely, these being a matter of design choice and desired effect. The following is a typical arrangement which gives due consideration to resolution of the pawl sweep in a toy or game of relatively small physical dimensions, providing a game which has a reasonable average number of strokes per lap, and the ability of players to discriminate between different step sizes in an attempt to control the advancement of the rings.

If recesses 33 and 34 in inner wall 13 span 38° and stops 35 and 36 each define an arc of 10°, cover 17 can be advanced on a full stroke a maximum of 28° relative to base 11. However the angular advancement of each track for such a full stroke will depend on the location of the teeth on that track and the location of the notches on the associated program ring. To avoid the difficult task of finding several angular distributions of teeth and notches which provide identical odds for all tracks and preserve the desired characteristics, the distribution of teeth on two tracks can be identical. For example, tracks **25*a* and 25*c* can have the same angular sequence of teeth. Similarly, the distribution of notches on two program rings can be identical as for example 24*a* and 24*c*. An identical arrangement can be utilized for the other tracks, such as 25*b* and 25*d*, and other rings, such as 24*b* and 24*d*, utilizing the same angular displacement of teeth and notches but with the added modification of placing them in reverse order. Since, however, the arrangement of identical distribution on any two tracks would result in the maintenance of identical relationships, thereby destroying the difference in the motion of the individual tracks, the indexing elements, such as 41*b* and 41*d* in FIG. 6, of two tracks having the same distribution of teeth are extended through different arcs on each track, as for example 20° on track 25*a* and 11° on track 25*c***. This arrangement causes the pawls to move the associated program ring by different amounts during resetting so that any identical relationship which might exist between two rings and their associated tracks is destroyed in the course of resetting.

A typical distribution of teeth on a track is as follows:

TABLE I

| Typical Distribution of Teeth | |
|---|---|
| Tooth No. | Radians |
| 1 | 9° |
| 2 | 16° |
| 3 | 16° |
| 4 | 9° |
| 5 | 8° |
| 6 | 15° |
| 7 | 10° |
| 8 | 15° |
| 9 | 16° |
| 10 | 9° |
| 11 | 8° |
| 12 | 15° |
| 13 | 10° |
| 14 | 15° |
| 15 | 16° |
| 16 | 9° |
| 17 | 8° |

TABLE I-continued

| Typical Distribution of Teeth | |
|---|---|
| Tooth No. | Radians |
| 18 | 15° |
| 19 | 10° |
| 20 | 15° |
| 21 | 16° |
| 22 | 9° |
| 23 | 8° |
| 24 | 15° |
| 25 | 10° |
| 26 | 15° |
| 27 | 16° |
| Indexing element | 27° |

The program ring associated with such a track is designed so that the sum of the angular displacement of any four consecutive notches will total less than 28°; e.g. a 23° or a 25° to 27° sweep. For example, a suitable spacing sequence of notches over four sectors (each of about 90°) of a ring to be used with the track spacings shown in Table I could be as follows:

TABLE II

| Typical Program Ring Spacing Sequence | | | |
|---|---|---|---|
| 1st Sector | 2nd Sector | 3rd Sector | 4th Sector |
| 6° | 7° | 4° | 6° |
| 6° | 4° | 7° | 6° |
| 6° | 6° | 6° | 7° |
| 7° | 6° | 6° | 8° |
| 4° | 7° | 6° | 6° |
| 6° | 7° | 7° | 4° |
| 6° | 6° | 4° | 7° |
| 7° | 5° | 6° | 6° |
| 8° | 7° | 8° | 6° |
| 6° | 5° | 7° | 6° |
| 6° | 6° | 6° | 5° |
| 5° | 7° | 6° | 6° |
| 6° | 7° | 4° | 6° |
| 6° | 6° | 7° | 8° |
| 6° | 6° | 6° | |

With such a sequence, a 28° stroke of the top cover causes the pawls to span four notches on its associated program ring. After fifteen full strokes, sixty notches will have thus moved passed the starting radius. Utilizing fifty-nine notches on a ring results in that ring returning to its original position after four revolutions, fifty-nine strokes and 1440°. Within the field represented by these four revolutions, there will be a region where 23° sweeps predominate and a region where 25° to 27° sweeps predominate.

It will be noted that the teeth on the associated track, when taken two at a time, tend to form a pattern of 23° to 25° span. When paired the other way, they form a series consisting of 17°, 25° and +25° span. Consequently, the 25° to 27° sweep of the pawls have a high probability of moving the tracks through two teeth (17° to 25°) while the 23° sweep has a high probability of moving the tracks through one tooth (9° to 16°) or two teeth only if they add up to a 17° span.

The elements are designed so that all have the same overall probability of winning, if speed is the object as in a race. The complete course of any given race composed of full strokes is determined by the relative positions of the individual program rings at the outset. The fastest possible one lap race with the above distribution of teeth and notches is one of fifteen moves whereas the slowest possible one is twenty-four moves. The difference between these two is sufficiently large that the probability of two or more elements finishing at the same time is minimized. No easily recognizable pattern of moves develops which would enable a player to predict with certainty the subsequent series of moves. Suspense is thus preserved since an element can "come from behind" to win.

The probability distribution for the number of full strokes required to finish one random lap are as follows:

TABLE III

| Probability Distribution of Number of Strokes Needed for One Lap | |
|---|---|
| No. of Full Strokes Per Lap | Probability (Over 59) |
| 15 | 5 |
| 16 | 5 |
| 17 | 8 |
| 18 | 7 |
| 19 | 5 |
| 20 | 8 |
| 21 | 7 |
| 22 | 6 |
| 23 | 4 |
| 24 | 4 |

The above analysis is based on the assumption that each turn is a full stroke. When a stroke smaller than 28° is made, and one, two or three notches in the program ring, instead of four, are spanned by the pawl, the rings can be viewed as having "jumped" approximately 360°, 720°, or 1080° within the 1440° field. It is thus possible for a player to cause a ring to go from an unfavorable region to one believed to be favorable while at the same time placing a competitor's ring in a region believed to be less favorable.

If the toy is used as a competitive game, with several players moving in turn, it is sometimes possible for the player's intuition and experience to provide an input. While each step is unpredictable, the general trend of an element's performance in the race is, to some extent, noticeable with experience. Utilizing an approximate quarter, half, or three-quarter stroke, instead of a full one, a player can drastically change the subsequent course of the race by making such a partial move at an appropriate time, thereby improving performance of his element while hindering that of his competitor's element.

A large variety of races is possible. Utilizing the distribution given above by way of exemplification, each track can proceed through as many as thirty-three or thirty-four different sequences. Each one lap race of four tracks utilizing full strokes therefore can follow more than a million different courses. Utilization of partial strokes, as described above, provides an almost astronomical number of different possibilities.

It is of course apparent that other designs and arrangements can be accommodated by this device without departing from the basic spirit of the invention. For example, any number of tracks can be provided. The sequence of the teeth and notches is largely a matter of design choice. The pawls can be activated by any convenient mechanism. The device, although advantageously fabricated from plastic, can be constructed from any suitable material. Other obvious modifications will be immediately apparent to those skilled in the art.

What is claimed is:

1. A varied track advancement game mechanism comprising (a) a base; (b) a plurality of circular tracks disposed on said base for concentric rotational advancement, each of said tracks having a plurality of teeth defining spaced interdental recesses; (c) pawl means associated with each of said tracks, said pawl means being operable to engage said track teeth for advancement of said track in a first rotational direction; (d) means operable to rotationally advance in unison all of said pawl means in said first direction and to thereby advance any of said tracks engaged by its associated pawl means; and (e) a plurality of program rings, each of said program rings being disposed in concentric, adjacent relationship with one of said tracks for independent rotational advancement, said program ring having (i) a pawl-restraining surface operable to prevent said pawl means from entering said interdental track recesses for engagement of said teeth and (ii) a plurality of notches defined in said surface and operable to permit descent of said pawl means from said restraining surface into said interdental track recesses for engagement of said teeth.

2. A game mechanism according to claim 1 including a cover, said cover being rotatably mounted on said base and having on its inner surface a plurality of channels operable to receive said tracks.

3. A game mechanism according to claim 2 wherein said pawl means are disposed in said cover.

4. A game mechanism according to claim 3 including spring means urging said cover in one rotational direction and spaced stop means defining the maximum rotational angle through which said cover can be rotated relative to said base.

5. A game mechanism according to claim 4 wherein the angular interval of at least some adjacent notches on each of said rings is different from the angular interval of other adjacent notches on the same ring.

6. A game mechanism according to claim 4 wherein the angular interval of the interdental spaces on each of said tracks is different from the angular interval of other interdental spaces in the same track.

7. A game mechanism according to claim 6 wherein the angular interval of at least some adjacent notches on each of said rings is different from the angular interval of other adjacent notches on the same ring, said notches being disposed such that the sum of the angular intervals of a preselected plurality of sequential notches is less than the maximum rotational angle through which said cover can be rotated.

8. A game mechanism according to claim 4 wherein each of said tracks also includes an indexing element operable to permit alignment of all of said tracks.

* * * * *